US011607778B2

(12) United States Patent
Blanchette

(10) Patent No.: US 11,607,778 B2
(45) Date of Patent: Mar. 21, 2023

(54) GREASE FITTING INSTALLATION TOOL AND METHOD

(71) Applicant: Roy Joseph Blanchette, Prince George (CA)

(72) Inventor: Roy Joseph Blanchette, Prince George (CA)

( * ) Notice: Subject to any disclaimer, the term of this patent is extended or adjusted under 35 U.S.C. 154(b) by 191 days.

(21) Appl. No.: 17/155,378

(22) Filed: Jan. 22, 2021

(65) Prior Publication Data

US 2021/0146509 A1 May 20, 2021

Related U.S. Application Data

(63) Continuation-in-part of application No. 15/923,589, filed on Mar. 16, 2018, now abandoned.

(51) Int. Cl.

| | |
|---|---|
| ***B25B 13/50*** | (2006.01) |
| ***B25B 23/12*** | (2006.01) |
| ***B25B 23/10*** | (2006.01) |
| ***B25B 13/48*** | (2006.01) |

(52) U.S. Cl.
CPC ..... *B25B 13/50* (2013.01); *B25B 13/481* (2013.01); *B25B 23/108* (2013.01); *B25B 23/12* (2013.01)

(58) Field of Classification Search
CPC ..... B25B 13/06; B25B 13/248; B25B 13/005
See application file for complete search history.

(56) References Cited

U.S. PATENT DOCUMENTS

| | | | | |
|---|---|---|---|---|
| 1,867,372 | A | 7/1932 | Mcguckin | |
| 2,274,753 | A | 3/1942 | Sundholm | |
| 2,294,193 | A | 8/1942 | Merriman | |
| 2,453,901 | A * | 11/1948 | Gonsett | B25F 1/04 81/437 |
| 2,752,811 | A | 7/1956 | Wenchel | |
| 2,803,158 | A * | 8/1957 | King | B25B 13/105 81/185 |
| 2,832,245 | A * | 4/1958 | Burrows | B25B 13/483 81/125 |
| 3,680,159 | A * | 8/1972 | Wharram | B25B 13/483 7/138 |
| 3,855,882 | A | 12/1974 | Wittmann | |
| 3,875,829 | A * | 4/1975 | Evans | B25B 13/58 81/185 |
| 3,924,492 | A | 12/1975 | Bray | |
| 4,663,998 | A | 5/1987 | Parsons et al. | |

(Continued)

*Primary Examiner* — Jacob J Cigna
(74) *Attorney, Agent, or Firm* — Michael C. Balaguy

(57) ABSTRACT

A grease fitting installation tool is disclosed. The grease fitting installation tool may include a hand tool useful for installing and uninstalling a grease fitting with a hexagonal collar, a threaded shank, and a nipple, i.e., a Zerk fitting. The hand tool may have a first tool head and a second tool head, each able to receive and manipulate a grease fitting. The first and second tool heads may be attached end to end, joining the heads in the center of a hand tool by a couple. The couple may have a wrench interface allowing the hand tool to be engaged by a wrench or other tool. Each tool head may include a hollow socket with a socket aperture and six internal contact surfaces that are hexagonally arranged. The tool head may also include a deformable, cylindrical gripping member disposed within the hollow socket for retaining the grease fitting when the grease fitting is inserted into the gripping member.

17 Claims, 7 Drawing Sheets

(56) References Cited

U.S. PATENT DOCUMENTS 5,048,379 A 9/1991 Gramera
5,074,172 A 12/1991 Fetter
D338,146 S 8/1993 Gramera
5,285,543 A * 2/1994 Rowe ..... B25B 13/06 81/177.4
5,595,096 A 1/1997 Coffman
5,713,386 A 2/1998 Heredia Batista et al.
5,862,725 A * 1/1999 Negus ..... B25B 13/48 81/461
5,868,224 A 2/1999 DiCarlo
6,182,537 B1 2/2001 Vasichek et al.
6,269,717 B1 8/2001 Bollinger
6,354,176 B1 * 3/2002 Nordlin ..... B25B 13/06 81/121.1
6,729,208 B1 5/2004 Chrzanowski
D510,847 S * 10/2005 McKnight ..... D8/29
7,004,214 B1 2/2006 Awad
7,104,164 B2 * 9/2006 Jirele ..... B25B 23/108 81/124.6
7,334,506 B2 * 2/2008 Hui ..... B25B 13/102 81/DIG. 11
7,340,984 B2 * 3/2008 Hsieh ..... B25B 13/06 81/177.85
7,926,393 B2 4/2011 Hart
9,138,873 B2 * 9/2015 Merrick ..... B25B 23/0035
9,272,395 B2 * 3/2016 Hui ..... B25B 13/065
9,381,624 B1 * 7/2016 Patterson ..... B25B 13/065
9,989,185 B2 * 6/2018 Boland ..... F16L 55/18
2004/0065176 A1 4/2004 Lin
2005/0014596 A1 1/2005 Hsien
2008/0121073 A1 * 5/2008 Williams ..... B25B 13/02 81/121.1
2009/0211408 A1 8/2009 Peng
2010/0000378 A1 1/2010 Hart
2011/0314973 A1 12/2011 Tsai
2013/0014617 A1 1/2013 Kafka

* cited by examiner

GREASE FITTING INSTALLATION TOOL AND METHOD

RELATED APPLICATIONS

This application claims the benefit of U.S. non-provisional patent number application Ser. No. 15/923,589, filed on 16 Mar. 2018, pending, the entire disclosure of which is incorporated in this disclosure by this reference.

BACKGROUND OF THE INVENTION

The following includes information that may be useful in understanding the present disclosure. It is not an admission that the information provided is prior art nor material to the described or claimed inventions, nor that any publication or document expressly or implicitly referenced is prior art.

TECHNICAL FIELD

The present invention generally relates to hand tools of existing art and specifically relates to a mechanical drive tool.

RELATED ART

Since 1929, a variant of grease fittings known as 'Zerk' or 'Alemite' fittings have been widespread use as an effective and nearly universal means of servicing greased bearings while preventing loss or contamination of the grease contained by the fitting. These grease fittings are serviceable by a pressurized greasing gun that attaches to a nipple on the fitting top. The grease fitting is usually threaded into a mechanical component containing grease by a tapered thread. These fittings commonly include a hexagonal collar that may be engaged by a hand tool to be removed by rotating the fitting within the mechanical component.

Unfortunately, by nature of the complexity of many machines utilizing grease fittings, it may be challenging to obtain ample access and room to install or remove the fitting. Due to the small size of the fittings, they may often be dropped and lost or damaged once removed from the machine or while attempting to install. The inevitable presence of oil or grease may exacerbate this problem. A suitable solution is desired.

U.S. Pat. No. 1,867,372 to John J. McGuckin relates to a grease fitting tool. The described grease fitting tool allows manipulating grease fittings such as everyday use under the name of the Zerk or the Alemite fittings for automobiles and similar machines. The wrench element is provided with suitable means for turning it by hand, such as a crossbar passed through and firmly held in the tool's body. It is convenient to finish one end of such crossbar to form an extractor, which may be driven into the bore of a broken fitting to back it out of its seat, and to finish the other end with a tap which may clear the thread in the seat for the fitting.

SUMMARY

Given the preceding disadvantages inherent in the known hand tool art, the present disclosure provides a novel grease fitting installation tool and method. The general purpose of the present disclosure, which will be described subsequently in greater detail, provides an efficient and effective grease fitting installation tool and method.

A grease fitting installation tool is disclosed herein. The grease fitting installation tool may include a hand tool useful for installing and uninstalling a grease fitting with a hexagonal collar, a threaded shank, and a nipple, i.e., a Zerk fitting. The hand tool may have a first tool head and a second tool head, each able to receive and manipulate a grease fitting. The first and second tool heads may be attached end to end, joined in the center of a hand tool by a couple. The couple may have a wrench interface allowing the hand tool to be engaged by a wrench or other tool. Each tool head may include a hollow socket having a socket aperture and six internal contact surfaces, which are hexagonally arranged. The six internal contact surfaces may releasably engage the hexagonal collar of the grease fitting such that the grease fitting may not rotate within the hollow socket while in engagement with the six internal contact surfaces. The tool head may also include a deformable, cylindrical gripping member disposed within the hollow socket. The gripping member may have an interior diameter smaller than the exterior diameter of the nipple of the grease fitting. This may enable the gripping member to deform around the nipple of the grease fitting when the grease fitting is inserted into the gripping member.

According to another exemplar, a method of installing a grease fitting is also disclosed. The method of installing a grease fitting may include first, providing the described grease fitting installation tool; second, inserting the grease fitting into the hollow socket, such that the hexagonal collar of the grease fitting engages with the six internal contact surfaces (or more or less) of the hollow socket; third, placing the threaded shank of the grease fitting against a grease fitting receptacle; fourthly, rotating the hand tool clockwise to advance the threaded shank of the grease fitting within the grease receptacle; fifthly, removing the hand tool from the grease fitting; and sixthly and optionally, rotating the hand tool counter-clockwise to withdraw the threaded shank of the grease fitting from within the grease fitting receptacle.

BRIEF DESCRIPTION OF THE DRAWINGS

The figures that accompany the written portion of this specification illustrate exemplars and methods of use for the present disclosure, a grease fitting installation tool and method, constructed and operative according to the present disclosure's teachings.

The exemplars of the present invention will be described with the appended drawings, wherein like designations denote like elements.

DETAILED DESCRIPTION

Figure 1:
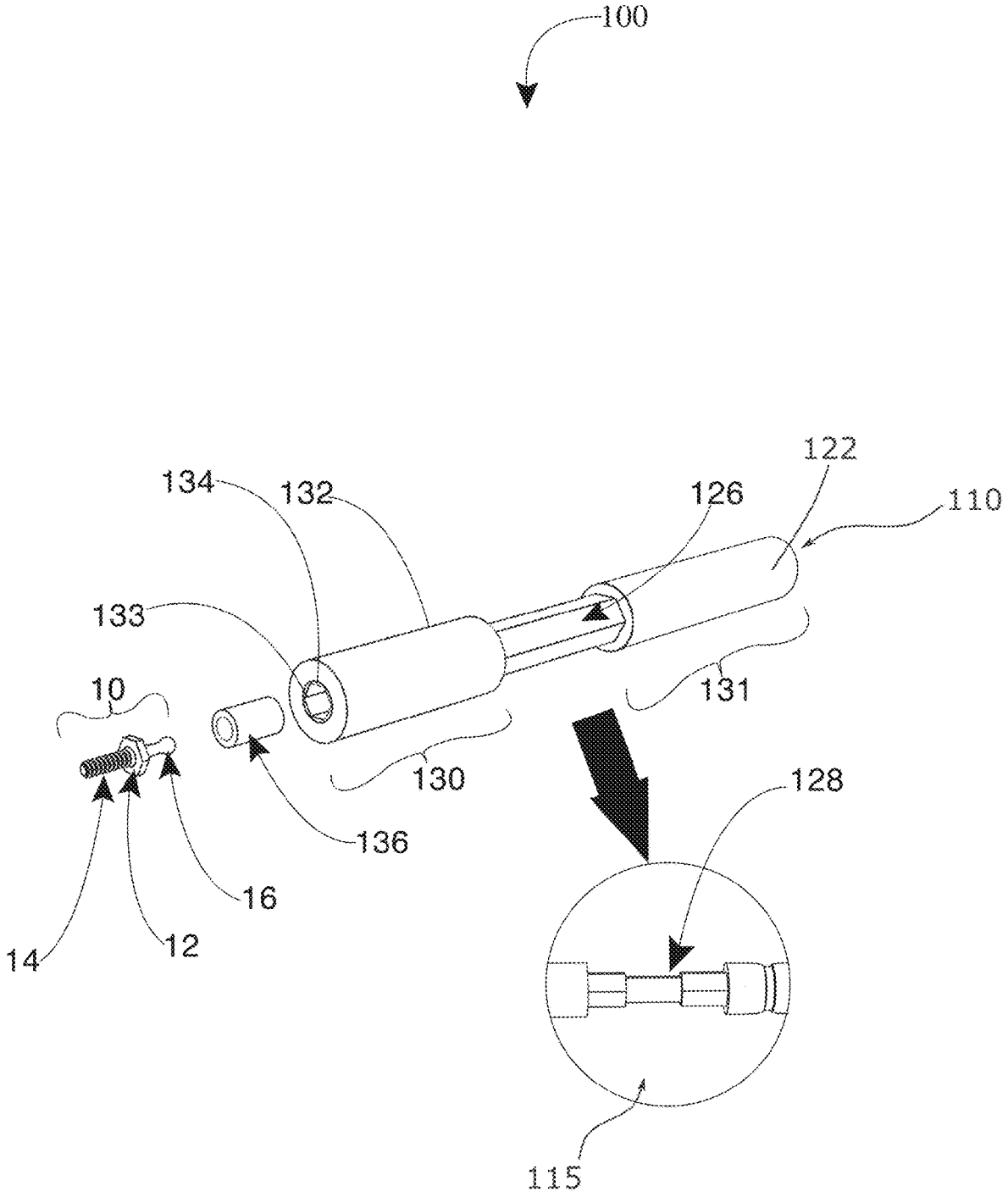
FIG. 1 is a perspective view of the grease fitting installation tool during an 'in-use' condition.

Exemplars of the present disclosure relate to a hand tool and, more particularly, to a grease fitting installation tool and method to improve the installation of a grease fitting.

Generally, the grease fitting installation tool may include a hand tool allowing a user to easily manipulate a grease fitting, especially a Zerk type (or other) fitting threaded into a mechanical component U-Joint or ball joint. The hand tool utilizes at least one socket with mechanisms for engaging and retaining such a grease fitting. Preferably, the hand tool includes two tool heads joined end to end with a wrench-engaging member between the two tool heads. The wrench-engaging member may have six hexagonally arranged faces or two opposing sides for a wrench or other tool to engage for rotating the hand tool. In use, the hand tool may engage the grease fitting, while a wrench is also used to turn the wrench-engaging member, imparting more torque to the hand tool than a user's hand can alone. The two tool heads are preferably of different sizes so two tools may be obtained in one item. For example, the first tool head may include a seven-sixteenth-inch socket, and the second tool head may include a five-sixteenth-inch socket. In another exemplar, the hand tool may have a handle, a single tool head, and a shaft connecting the handle to the tool head on the same axis that the grease fitting is threaded on. In either exemplar, the tool head contains a six-faced socket sized for one of several standard Zerk fitting sizes.

The socket includes a deformable, tubular insert concentric to the socket and only occupies a portion of its length. The interior of the tubular insert may be sized to accommodate the nipple of the grease fitting. It may be slightly smaller in diameter than the outside of the nipple. When the tubular insert engages the nipple, it deforms and retains the nipple both by friction and mechanical retention. The tubular insert preferably engages only the nipple, allowing the six-faced (or another number of sides) portion of the grease fitting to contact the socket and leaving the threaded portion of the grease fitting exposed outside the tool. In some exemplars, the tubular insert may be complemented or replaced by a magnetic insert capable of retaining a ferrous grease fitting in direct contact with the magnet. Two standard sizes of sockets used may be five-sixteenths and seven-sixteenths of an inch. Other Imperial or metric sizes may be used, especially if they correspond to a commercially available grease fitting size.

In use during an installation process, the hand tool may retain a grease fitting within the tool head by the mechanisms described. A user may grasp the tool to place and orient the grease fitting relative to a mechanical component. The grease fitting is to be installed, especially a threaded aperture able to receive the threaded portion of the grease fitting. Once oriented correctly, the user may rotate the hand tool to thread the grease fitting into the mechanical component. A wrench may turn the hand tool. The hand tool may have enough mechanical strength to convey sufficient torque from the user or the wrench to the grease fitting for permanent installation and sealing. The hand tool retains the grease fitting within the hand tool throughout orientation and installation, allowing easy installation of an often too small component to be easily manipulated by a user's hand, especially in difficult-to-reach and low-visibility conditions.

During a removal process, the hand tool may engage a grease fitting already installed in a mechanical component and may be turned to disengage the threaded portion of the grease fitting from the mechanical component. The hand tool is useful because the grease fitting is retained within the hand tool and is not dropped or lost when removed from the mechanical component.

FIGS. 1-4 shows various views of a hand tool 100.

Figure 6A:
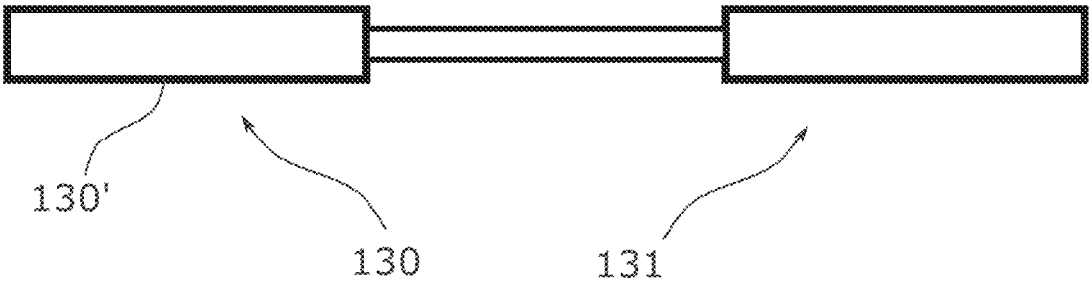
FIG. 6A is a schematic view of a version of the disclosed tool.
Figure 6B:
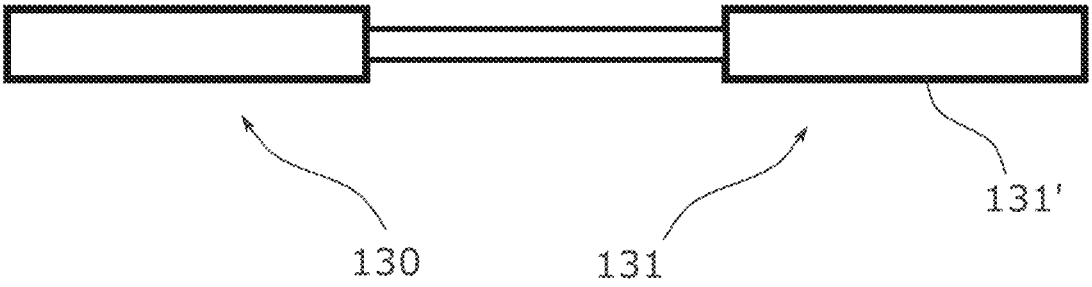
FIG. 6B is a schematic view of another version of the disclosed tool.
Figure 6C:
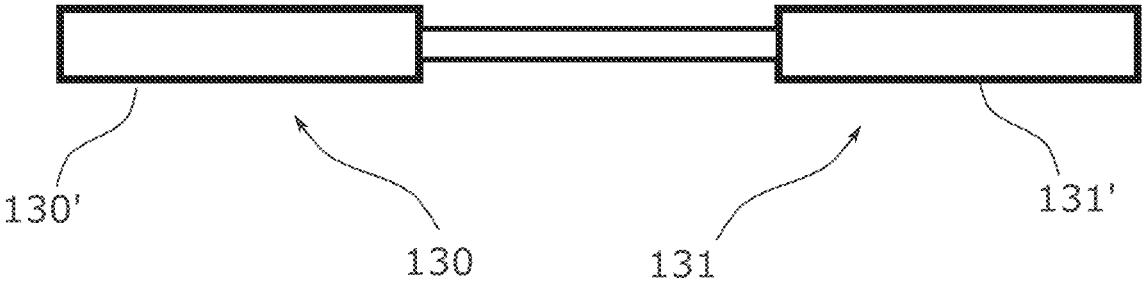
FIG. 6C is a schematic view of another version of the disclosed tool.
Figure 7A:
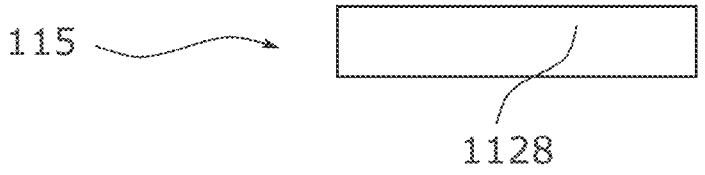
FIG. 7A is a schematic view of a shaft portion of a version of the disclosed tool.
Figure 7B:
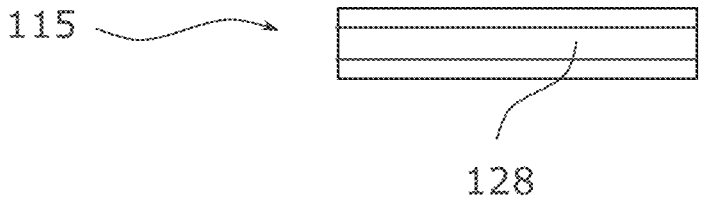
FIG. 7B is a schematic view of a shaft portion of another version of the disclosed tool.
Figure 7C:
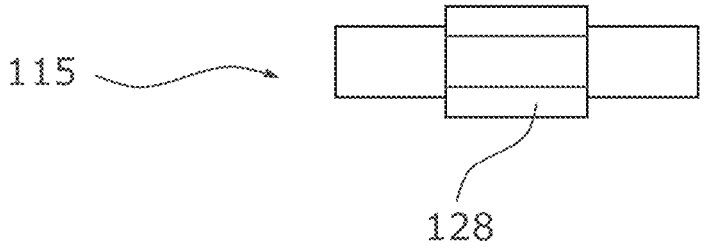
FIG. 7C is a schematic view of a shaft portion of another version of the disclosed tool.
Figure 7D:
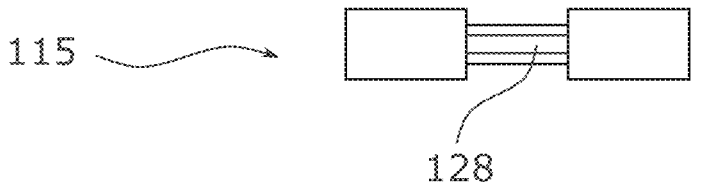
FIG. 7D is a schematic view of a shaft portion of another version of the disclosed tool.
Figure 7E:
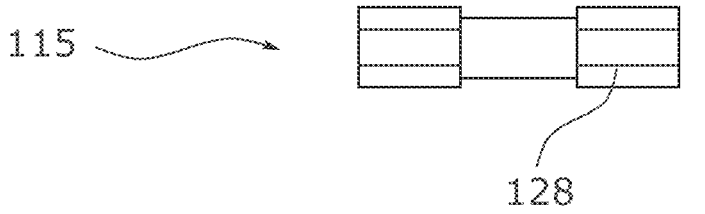
FIG. 7E is a schematic view of a shaft portion of another version of the disclosed tool.

According to an exemplar of the present disclosure, FIG. 1 shows a hand tool 100 during an 'in-use' condition. Here, hand tool 100 may install a grease fitting. As illustrated, hand tool 100 may include first tool head 130, second tool head 131, and shaft 115. hand tool 100 may be useful for installing or uninstalling grease fitting 10, grease fitting 10 having hexagonal collar 12, threaded shank 14, and nipple 16. hand tool 100 may include handle 110. Handle 110 is structured and was grasped by a user. In some versions, shaft 115 comprises handle 110. In these or other versions, first tool head 130 (FIG. 6A), second tool head 131 (FIG. 6B), or both first tool head 130 and second tool head 131 may also have grip regions (130'; 131') that can serve as handles. First tool head 130 and second tool head 131 include hollow socket 132 and gripping member 136. Shaft 115 may be configured to engage a wrench and may include couple-axis 122. Shaft 115 may join first tool head 130 to second tool head 131. Shaft 115 may include one or more pairs of substantially flat, parallel faces 128 to be engaged by a wrench, etc., extending a distance along couple-axis 122. In some versions, shaft 115 may include three pairs of faces 128, angled sixty degrees from an adjacent pair, forming a hexagonal portion on shaft 115. First tool head 130 and second tool head 131 are positioned concentrically to couple-axis 122, such that first tool head 130 or second tool head 131 may engage and turn grease fitting 10 while rotating on couple-axis 122. As seen in FIGS. 7A-7E, various versions of shaft 115 may have a smooth region 1128 that extends the length of shaft 115, FIG. 7A. Shaft 115 may have a faceted region that extends the length of the shaft, FIG. 7B. Shaft 115 may have a faceted region that extends less than the length of the shaft with the faceted region disposed midway along shaft 115 with the diameter larger than at least one end of shaft 115, FIG. 7C. Shaft 115 may have a faceted region that extends less than the shaft's length, with the faceted region disposed midway along the shaft having a diameter smaller than at least one end of shaft 115, FIG. 7D. Shaft 115 may have a smooth region along a middle length of shaft 115 with faceted versions on one or more ends of shaft 115, FIG. 7E. Other arrangements of smooth versus faceted regions of shaft 115 exist.

Hollow socket 132 may have socket aperture 133 and six (or the like) internal contact surfaces 134. Six internal contact surfaces 134 may be hexagonally (or other) arranged and may engage hexagonal collar 12 of grease fitting 10 grease fitting 10 releasably may not rotate relative to hollow socket 132 while in engagement with six internal contact surfaces 134. Gripping member 136 may be deformable, tubular-shaped, and disposed concentrically within hollow socket 132. It may be internally smaller than nipple 16 of grease fitting 10, such that gripping member 136 deforms around nipple 16 of grease fitting 10 when grease fitting 10 is inserted into gripping member 136.

Figure 2:
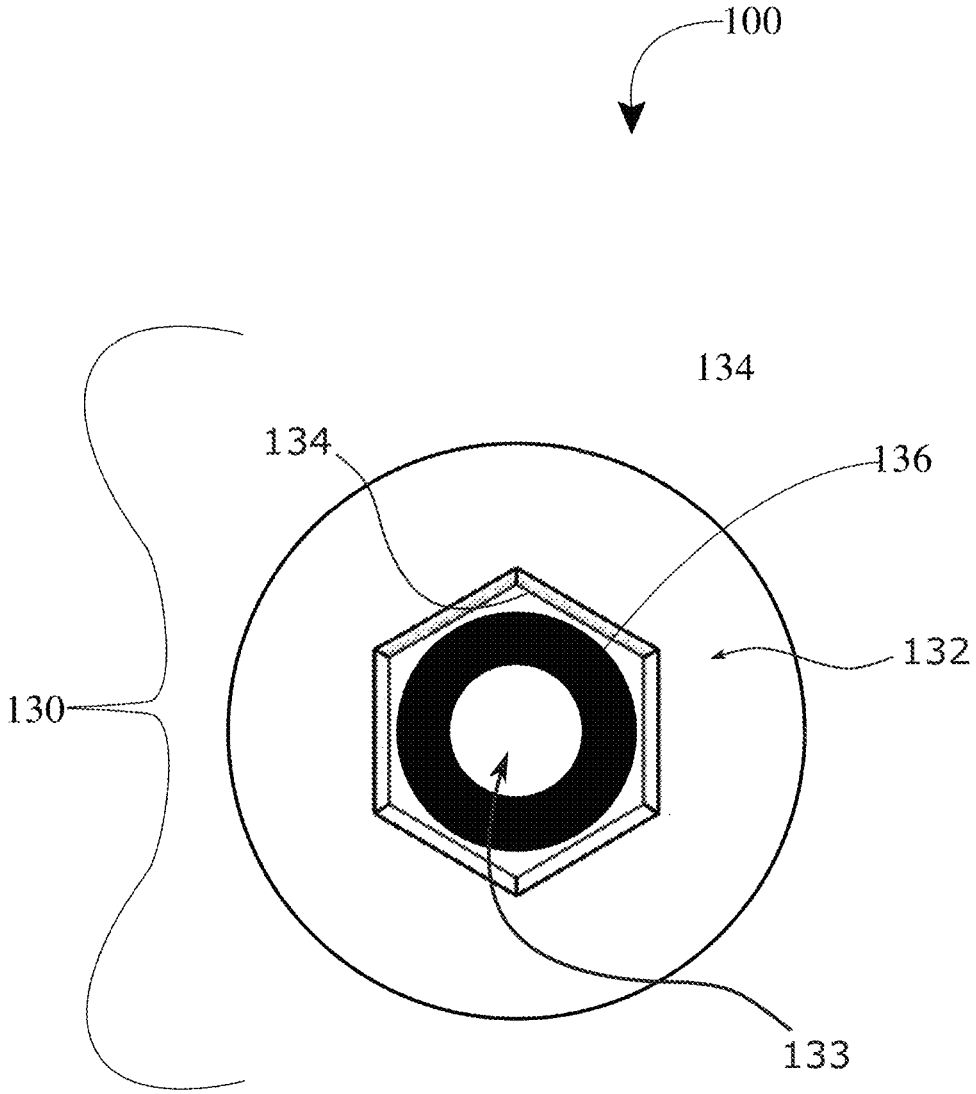
FIG. 2 is a front perspective view of the grease fitting installation tool of FIG. 1.

FIG. 2 shows a hand tool of FIG. 1, according to an exemplar of the present disclosure. As above, hand tool 100 may include first tool head 130, hollow socket 132, six internal contact surfaces 134, and gripping member 136. Gripping member 136 may be removably attached to hollow socket 132, and gripping member 136 is retained within hollow socket 132 by friction. Gripping member 136 may rubber, silicone, neoprene, or other deformable materials. The tubular insert may be complemented or replaced by a magnetic insert capable of retaining a ferrous grease fitting in direct contact with the magnet.

Figure 3:
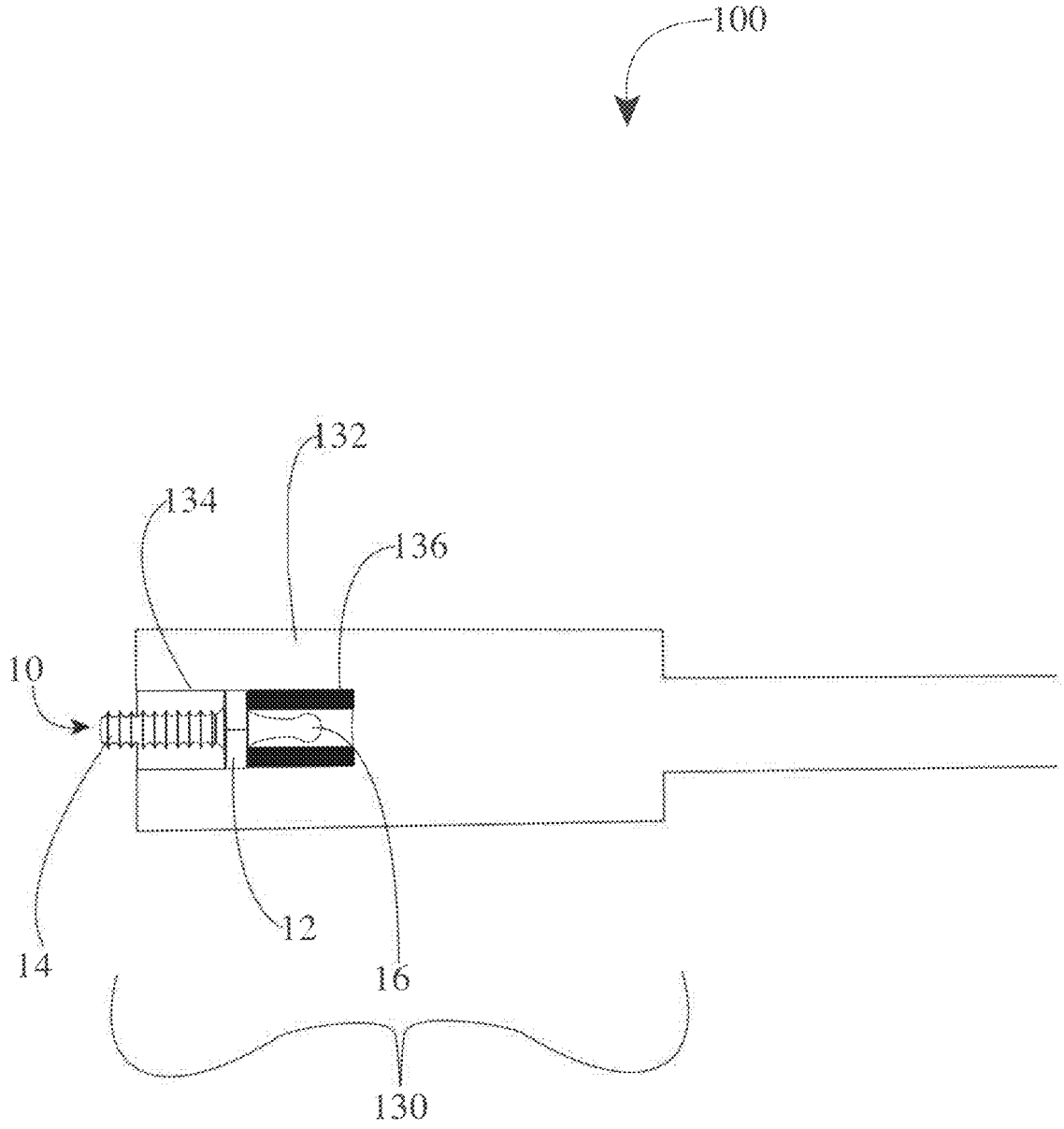
FIG. 3 is a cutaway view of the tool head of the grease fitting installation tool of FIG. 1.

FIG. 3 shows a cutaway view of first tool head 130 of hand tool 100. As above, hand tool 100 may include first tool head 130, hollow socket 132, six internal contact surfaces 134, and gripping member 136. In one exemplar, six internal contact surfaces 134 of hollow socket 132 measure within five percent of five-sixteenths of an inch in diameter across-flats, six internal contact surfaces 134 being dimensioned to receive and engage grease fitting 10 having hexagonal collar 12 measuring approximately five-sixteenths of an inch in diameter across-flats. In an alternative exemplar, six internal contact surfaces 134 of hollow socket 132 may measure within five percent of seven-sixteenths of an inch in diameter across-flats, six internal contact surfaces 134 being dimensioned to receive and engage grease fitting 10 having hexagonal collar 12 measuring approximately seven-sixteenths of an inch in diameter across-flats. Other exemplars may incorporate alternative dimensions for six internal contact surfaces 134 of hollow socket 132, especially dimensions suitable for use with commercially available sizes of grease fitting 10.

Figure 4:
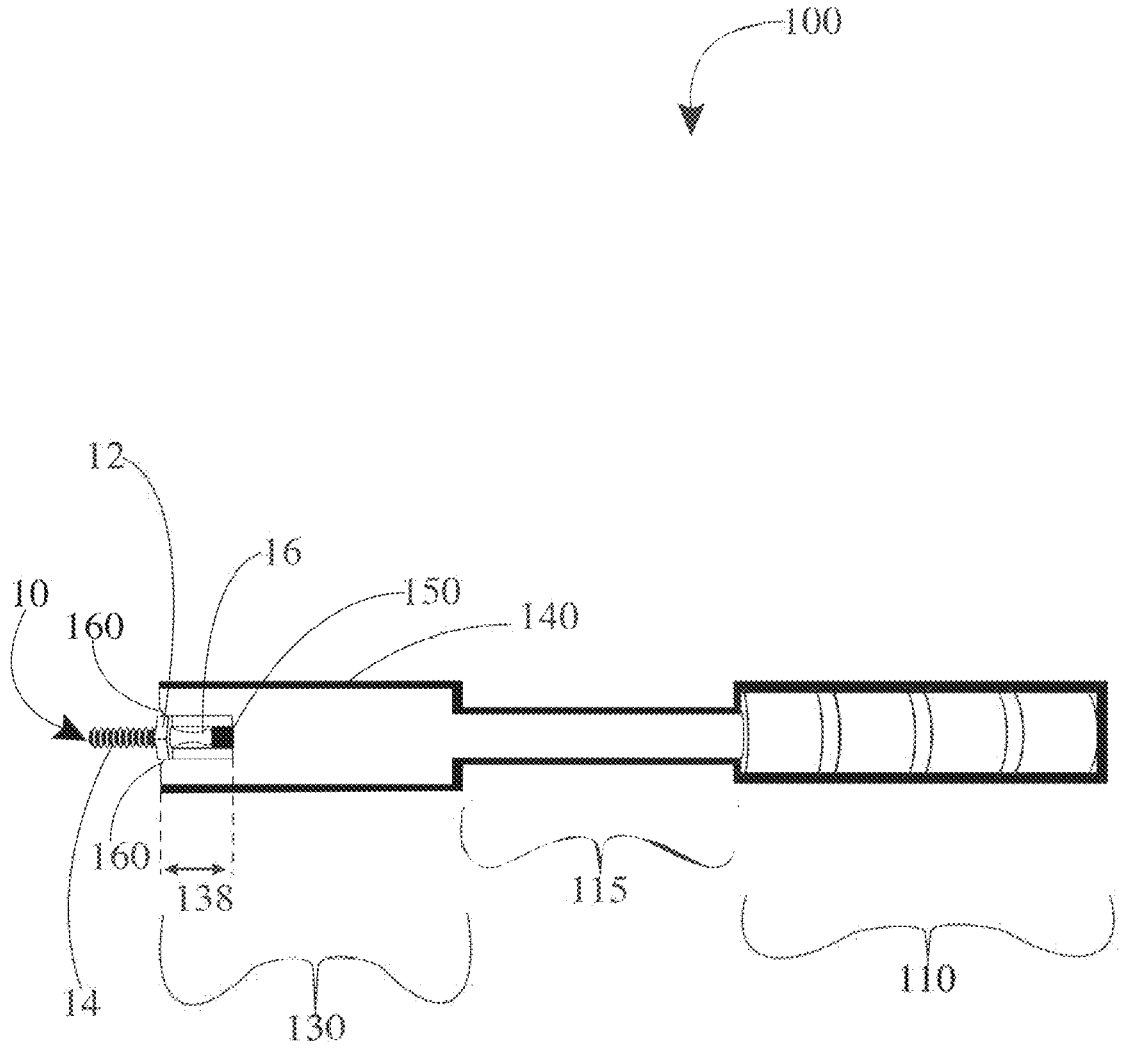
FIG. 4 is a cutaway view of the grease fitting installation tool of FIG. 1.

FIG. 4 is a cutaway view of hand tool 100 of FIG. 1. In one exemplar, hand tool 100 may further include handle 110 and shaft 115 coupling handle 110 to hollow socket 132. And hand tool 100 may include cover 140, cover 140 is permanently affixed to and enveloping handle 110. Cover 140 may also envelop shaft 115, hollow socket 132, and first tool head 130. Cover 140 may improve comfort and retention characteristics of hand tool 100 and improve corrosion-resistance and cleanability in some exemplars. Cover 140 may be constructed of rubber, silicone, neoprene, or other deformable materials. First tool head 130 may also include magnet 150 disposed interior to hollow socket 132; magnet 150 may contact ferrous grease fitting 10 when grease fitting 10 is received within hollow socket 132. Hollow socket 132 may also include socket length 138 axial to socket aperture 133 (FIG. 1). Hollow socket length 138 is dimensioned to cover nipple 16 and hexagonal collar 12 of grease fitting 10, such that threaded shank 14 is exposed when grease fitting 10 is received within hollow socket 132. And hollow socket 132 may still further include chamfer 160, such that chamfer 160 bounds socket aperture 133 and enable easy insertion of grease fitting 10 into hollow socket 132. Handle 110, shaft 115, and first tool head 130 may be constructed of ferrous steel, stainless steel, aluminum, or another strong material able to withstand enough torque to fasten and unfasten grease fitting 10. In some exemplars, handle 110, shaft 115, and first tool head 130 may be releasably affixed to each other. In other exemplars, handle 110, shaft 115, and first tool head 130 may be integral to each other. Shaft 115 may be rigidly coupled to handle 110, and first tool head 130 may be rigidly coupled to shaft 115.

Some versions of this hand tool do not comprise an internal drive fitting. There are versions in which one or both of the tool heads serve as handles or additional handles. In some versions, the first tool head is 3-4 inches long. In some versions, the second tool head is 3-4 inches long. In some versions, the shaft or handle or middle handle is 3-4 inches long. This can facilitate rotating the tool by hand, placing 2-4 fingers on the middle handle or shaft.

Figure 5:
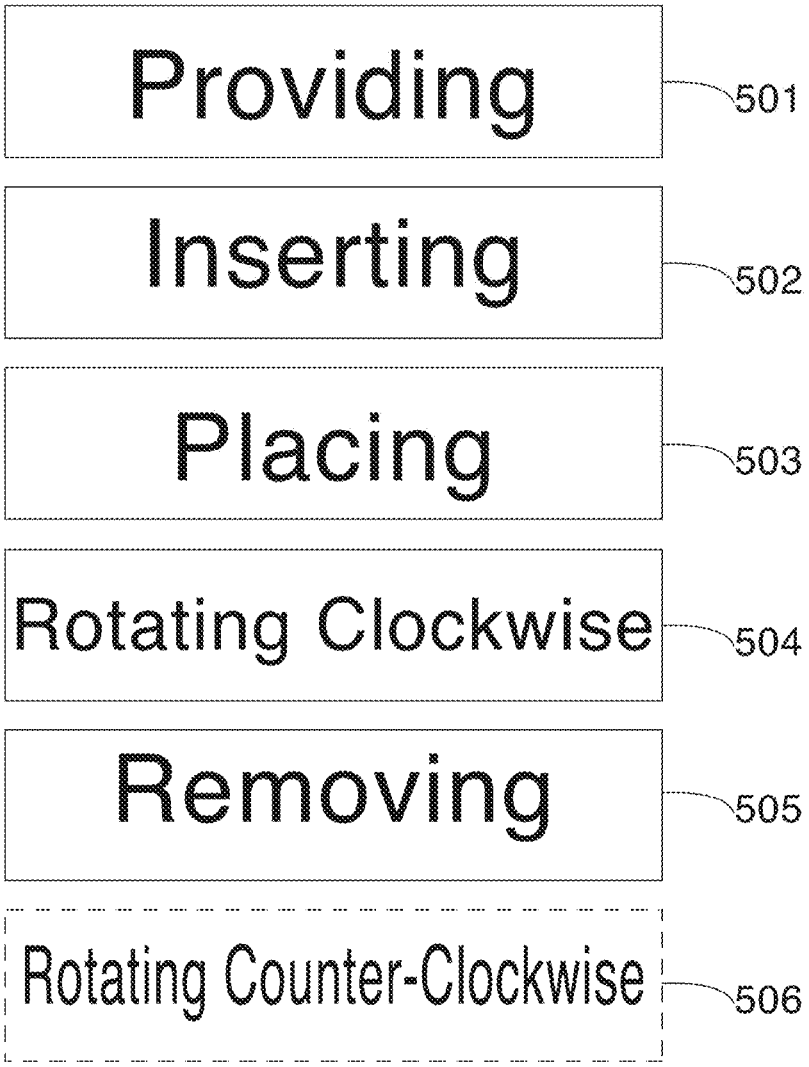
FIG. 5 is a flow diagram illustrating a method of installing a grease fitting.

FIG. 5 shows a flow diagram illustrating a method of installing a grease fitting. The method for installing a grease fitting may include one or more components or features of the hand tool 100 as described above. As illustrated, the method for installing a grease fitting may include the steps of step 501, providing a hand tool for installing a grease fitting, the grease fitting having a hexagonal collar, a threaded shank, and a nipple, the hand tool comprising a first tool head and a second tool head, the first tool head and the second tool head each including a hollow socket having a socket aperture and six internal contact surfaces hexagonally arranged, the six internal contact surfaces being able to releasably engage the hexagonal collar of the grease fitting such that the grease fitting may not rotate relative to the hollow socket while in engagement with the six internal contact surfaces, and a deformable, cylindrical gripping member disposed within the hollow socket having an interior diameter, the interior diameter being smaller than an exterior diameter of the nipple of the grease fitting, such that the gripping member deforms around the nipple of the grease fitting when the grease fitting is inserted into the gripping member, and a tool head couple joining the first tool head to the second tool head, the tool head couple having a couple-axis and a tool-interface configured to engage with a wrench; step 502, inserting the grease fitting into the hollow socket, such that the hexagonal collar of the grease fitting engages with the six internal contact surfaces of the hollow socket; step 503, placing the threaded shank of the grease fitting against a grease fitting receptacle; step 504, rotating the hand tool clockwise to advance the threaded shank of the grease fitting within the grease receptacle; step 505, removing the hand tool from the grease fitting; and step 506, rotating the hand tool counter-clockwise to withdraw the threaded shank of the grease fitting from within the grease fitting receptacle.

Step 506 is optional and may not be always implemented. Optional steps of the method of use are illustrated using dotted lines in FIG. 5 to distinguish them from the other steps of the method of use. The steps also described in the method of use can be carried out in many orders according to user preference.

What is claimed:

1. A hand tool for installing a grease fitting having a collar, a shank, and a nipple, the hand tool comprising:

a first tool head and a second tool head, the first tool head and the second tool head, each including a hollow socket having a socket aperture and socket sides configured to releasably engage the collar, and a deformable, cylindrical gripping member disposed within the hollow socket having an interior diameter smaller than an exterior diameter of the nipple;

a shaft joining the first tool head to the second tool head; and at least one tool-engaging portion circumscribing the shaft, the at least one tool-engaging portion having 2, 4, 6, or 8 sides;

wherein the shaft and the at least one tool-engaging portion are each smaller in diameter than the first tool head and the second tool head and wherein the tool does not comprise an internal drive fitting;

wherein the at least one tool-engaging portion does not extend fully between the first tool head and the second tool head;

wherein the shaft, where not circumscribed by the at least one tool-engaging portion, is round; and wherein the at least one tool-engaging portion consists of two tool-engaging portions, whereby the shaft bridges the two tool-engaging portions.

2. The hand tool of claim 1, wherein the hollow socket has a socket length longer than the grease fitting.

3. The hand tool of claim 1, wherein the shaft is 3-4 inches long.

4. The hand tool of claim 3, wherein the first tool head forms a first end handle or the second tool head forms a first end handle or the first tool head forms a first end handle and the second tool head forms a second end handle.

5. The hand tool of claim 4, wherein the first tool head or the second tool head, or both are 3-4 inches long.

6. The hand tool of claim 4, wherein the shaft prevents the first tool head from rotating separately from the second end handle.

7. The hand tool of claim 6, wherein the first tool head is, the second tool head is, or both the first and second tool heads are permanently connected to the shaft.

8. The hand tool of claim 7, wherein the at least one tool-engaging portion comprises two two tool-engaging portions each having 2, 4, 6, or 8 sides.

9. The hand tool of claim 8, wherein the at least one tool-engaging portion is hexagonal in cross-section.

10. The hand tool of claim 9, wherein at least one of the first tool head and the second tool head further include a magnet disposed inside the hollow socket such that the magnetic field of the magnet holds the grease fitting.

11. A method of installing a grease fitting comprising the steps of:

providing a hand tool for installing a grease fitting, the grease fitting has a collar, a shank, and a nipple, the hand tool comprising a first tool head and a second tool head, each including a hollow socket having a socket aperture, contact surfaces configured to engage the collar, and a deformable, cylindrical gripping member disposed within the hollow socket having an interior diameter smaller than an exterior diameter of the nipple, and a handle having a shaft with 2, 4, 6, or 8 sides joining the first tool head to the second tool head, wherein the at least one tool-engaging portion does not extend fully between the first tool head and the second tool head, wherein the shaft, where not circumscribed by the at least one tool-engaging portion, is round, and wherein the at least one tool-engaging portion consists of two tool-engaging portions, whereby the shaft bridges the two tool-engaging portions;

inserting the grease fitting into the hollow socket;

placing the shank against a grease fitting receptacle;

rotating the hand tool by placing three or more fingers onto the first tool head, the second tool head, or the handle to thread the shank into a grease fitting receptacle;

and removing the hand tool from the grease fitting.

12. The method of claim 11 further comprising the step of rotating the hand tool to unthread the shank from the grease fitting receptacle.

13. A hand tool for installing a grease fitting having a collar, a shank, and a nipple, the hand tool comprising:

a first tool head and a second tool head, the first tool head and the second tool head, each including a hollow socket having a socket aperture and socket sides configured to releasably engage the collar, and a deformable, cylindrical gripping member disposed within the hollow socket having an interior diameter smaller than an exterior diameter of the nipple;

a handle comprising a shaft joining the first tool head to the second tool head; and at least one tool-engaging portion circumscribing the shaft, the at least one tool-engaging portion having 2, 4, 6, or 8 sides;

wherein the at least one tool-engaging portion does not extend fully between the first tool head and the second tool head;

wherein the shaft, where not circumscribed by the at least one tool-engaging portion, is round;

wherein the at least one tool-engaging portion consists of two tool-engaging portions, whereby the shaft bridges the two tool-engaging portions;

wherein the shaft and the at least one tool-engaging portion are each smaller in diameter than the first tool head and the second tool head and wherein the tool does not comprise an internal drive fitting; and wherein the handle's diameter is smaller than the diameters of the first tool head and the second tool head.

14. The hand tool of claim 13, wherein the handle is 4-5 inches long.

15. The hand tool of claim 14, wherein the first tool head forms a first end handle or the second tool head forms a first end handle or the first tool head forms a first end handle and the second tool head forms a second end handle.

16. The hand tool of claim 15, wherein the first tool head or the second tool head, or both are 3-4 inches long.

17. The hand tool of claim 16, wherein the first tool head is, the second tool head is, or both the first and second tool heads are permanently connected to the handle.

* * * * *